US005959875A

United States Patent [19]

Kawahara et al.

[11] Patent Number: 5,959,875

[45] Date of Patent: Sep. 28, 1999

[54] ANALOG SIGNAL CHARACTERIZER FOR FUNCTIONAL TRANSFORMATION

[75] Inventors: Nobuaki Kawahara; Kenzo Urabe; Changming Zhou; Guoliang Shou, all of Tokyo, Japan

[73] Assignees: Kokusai Electric Co., Ltd.; Yozan Inc., both of Tokyo, Japan

[21] Appl. No.: 08/812,650

[22] Filed: Mar. 7, 1997

[30] Foreign Application Priority Data

Mar. 7, 1996 [JP] Japan ..... 8-079472

[51] Int. Cl.[6] ..... G06G 7/19

[52] U.S. Cl. ..... 364/827; 364/826

[58] Field of Search ..... 364/826–827, 364/725.02–725.03, 726.01–726.03, 726.07

[56] References Cited

U.S. PATENT DOCUMENTS 4,288,858 9/1981 Merola et al. ..... 364/725.02

OTHER PUBLICATIONS

Shoji Kawahito, et al., "A Discrete Fourier Analyzer Based On Analog VLSI Technology", IEICE Trans. Electron., vol. E77–C, No. 7, Jul. 1994 pp. 1049–1055.

*Primary Examiner*—Tan V. Mai

*Attorney, Agent, or Firm*—Pillsbury Madison & Sutro LLP

[57] ABSTRACT

A signal characterizer for performing functional transformations such as Fast Fourier Transforms (FFTs), which converts an input serial analog signal into a plurality of parallel discrete signals using an analog-type serial-to-parallel converter. The discrete signals are then supplied to the input terminals of butterfly operation circuits to process the parallel discrete signals into a plurality of transformed signals. A switch supplies the transformed signals to a serial signal output terminal. The switch is controlled by a controller so that the input signal sequence is converted to a serial signal sequence according to a predetermined order.

17 Claims, 11 Drawing Sheets

ANALOG SIGNAL CHARACTERIZER FOR FUNCTIONAL TRANSFORMATION

This invention is related to Japanese patent application 8-79472 filed on Mar. 7, 1996, the content of which is incorporated hereinto by reference.

BACKGROUND OF THE INVENTION

1. Field of the Invention

This invention relates to an analog signal characterizer for executing a functional transformation, such as fast Fourier transform (FFT) or fast Hadmard transform (FHT), and more particularly to an analog signal characterizer for converting an analog serial signal into discrete parallel signals to execute the functional transformation in parallel through butterfly operations.

2. Related Art

For functional transformation of a signal sequence having discrete numerical values, N-point discrete Fourier transform (DFT) is known, which is expressed by formula (1).

$$x_n = 1/N \cdot \sum_{k}^{N-1} X_k W_N^{kn} \tag{1}$$

The N-point DFT (i.e., DFT for signal sequence of length N) requires $N^2$ times multiplication. Fast Fourier transform (FFT) is an algorithm for performing the same operations all at once to reduce the operation time and efficiently execute DFT. Arithmetic operation of FFT will be explained using an eight (8) point ($N=2^3=8$) DFT as an example. In formula (1), where the N value is 8 (N=8), assume that the N/2 DFT values of the $X_n$ even terms are $B_0$, $B_1$, $B_2$ and $B_3$, and the N/2 DFT values of the $x_n$ odd terms are $C_0$, $C_1$, $C_2$ and $C_3$, then formula (2) is obtained.

$$X_0=B_0+C_0W_8^0 \tag{2}$$

$$X_1=B_1+C_1W_8^1$$

$$X_2=B_2+C_2W_8^2$$

$$X_3=B_3+C_3W_8^3$$

$$X_4=B_4+C_4W_8^4=B_0-C_0W_8^0$$

$$X_5=B_5+C_5W_8^5=B_1-C_1W_8^1$$

$$X_6=B_6+C_6W_8^6=B_2-C_2W_8^2$$

$$X_7=B_7+C_7W_8^7=B_3-C_3W_8^3$$

FIG. 1 shows the rotational factor $W_N^k$ of the formula (2). The rotational factor $W_N^k$ is a complex number for the angle $2\pi k/N$ as expressed by formula (3). The last four equations for $X_4$ to $X_7$ of formula (2) are obtained by replacing $W_8^4$ to $W_8^7$ by $-W_8^0$ to $-W_8^3$ using the characteristics of the rotational factor shown in FIG. 1.

$$W_N^k=-W_N^{(k\pm N/2)} \tag{3}$$

Formula (2) results from time division of the 8-point DFT into two 4-point DFT groups, namely, even terms $X_0$, $X_2$, $X_4$ and $X_6$, and odd terms $X_1$, $X_3$, $X_5$ and $X_7$. This signal flow is shown in FIG. 2. Suppose the DFT of the even terms among $X_0$, $X_2$, $X_4$ and $X_6$ (i.e., terms $X_0$ and $X_4$) are $D_0$ and $D_1$, and the DFT of the odd terms among $X_0$, $X_2$, $X_4$ and $X_6$ (i.e., terms $X_2$ and $X_6$) are $E_0$ and $E_1$. Then $B_0$ is the sum of $D_0$ and the product of $E_0$ and $W_8^0$. Similarly, $B_1$ is the sum of $D_1$ and the product of $E_1$ and $W_8^2$. $B_2$ is the sum of $D_0$ and the product of $E_0$ and $W_8^4$ ($-W_8^0$). $B_3$ is the sum of $D_1$ and the product of $E_1$ and $W_8^6$ ($-W_8^2$). These are expressed by formula (4). The blocks of N/2-point DFT (4-point DFT) shown in FIG. 2 is redrawn as FIG. 3 realizing the signal flow of formula (4).

$$B_0=D_0+E_0W_8^0 \tag{4}$$

$$B_1=D_1+E_1W_8^2$$

$$B_2=D_0+E_0W_8^4=D_0-E_0W_8^0$$

$$B_3=D_1+E_1W_8^6=D_1-E_1W_8^2$$

$$C_0=F_0+G_0W_8^0$$

$$C_1=F_1+G_1W_8^2$$

$$C_2=F_0+G_0W_8^4=F_0-G_0W_8^0$$

$$C_3=F_1+G_1W_8^6=F_1-G_1W_8^2$$

The pairs of $D_0$ and $D_1$, $E_0$ and $E_1$, $F_0$ and $F_1$, and $G_0$ and $G_1$ are N/4 DFT (2-point DFT), respectively. Therefore, formula (4) can be expressed as formula (5), in view of $W_8^0=1$ and $W_8^4=-1$.

$$D_0=x_0+x_4W_8^0=x_0+x_4 \tag{5}$$

$$D_1=x_0+x_4W_8^4=x_0-x_4$$

$$E_0=x_2+x_6W_8^0=x_2+x_6$$

$$E_1=x_2+x_6W_8^4=x_2-x_6$$

$$F_0=x_1+x_1W_8^0=x_1+x_5$$

$$F_1=x_1+x_1W_8^4=x_1-x_5$$

$$G_0=x_3+x_7W_8^0=x_3+x_7$$

$$G_1=x_3+x_7W_8^4=x_3-x_7$$

FIG. 4 shows a signal flow according to the butterfly operations of formulae (2) to (5). Eight discrete signals $x_0$ to $x_7$ are obtained by dividing the analog serial signal in the time domain and sampling the divided signals. The discrete signals $x_0$ to $x_7$ are transformed to eight new frequency signals $X_0$ to $X_7$.

In FIG. 4, addition operations are performed at the intersections of the signal lines. Among the intersections, negative addition operations (subtraction) are performed at the points indicated by "−1". At the points marked with $W_N^k$, the coefficients $W_N^k$ are multiplied to the corresponding signal. $D_0$, $D_1$, $E_0$, $E_1$, $F_0$, $F_1$, $G_0$, $G_1$, $B_0$, $B_1$, $B_2$, $B_3$, $C_0$, $C_1$, $C_2$ and $C_3$ are the intermediate calculation results of the signals $X_0$ to $X_7$.

For example, addition of signals $x_0$ and $x_4$ results in $D_0$, while subtraction of $x_4$ from $x_0$ results in $D_1$, which confirms the relationship shown in formula (5). Also, $B_0$ is obtained by adding $D_0$ to the product of $E_0$ and $W_8^0$, while $B_1$ is obtained by adding $D_1$ to the product of $E_1$ and $W_8^2$, which confirms the relationship shown in formula (4). $X_0$ is obtained by adding $B_0$ to the product of $C_0$ and $W_8^0$, while $X_1$ is obtained by adding $B_1$ to the product of $C_1$ and $W_8^1$, which confirms the relationship shown in formula (2).

In order to output the signals $X_0$ to $X_7$ in this order, the input serial signal must be rearranged into the prescribed order prior to the butterfly operations (along the crossing signal lines of FIG. 4). Without rearrangement, the output signals are not well-ordered, as shown in the signal flow of FIG. 5. However, it is known that the signal flow of FIG. 4 and that of FIG. 5 perform an equivalent functional transformation with only a difference in the order of input and output signals.

Although an FFT operation was used for the above example, fast Hadmard transform (FHT) can be performed if the weighting coefficient (rotational factor $W_N^k$) is shaped into two values of ±1 using the function shown in formula (6).

$$sgn(x)=1(x>0)\ sgn(x)=-1(x<0) \tag{6}$$

Conventionally, digital-type signal characterizers are used to perform a functional transformation, such as FFT or FHT. However, to perform parallel calculations with a digital-type signal characterizer, many multipliers are necessary, making the circuit of the signal characterizer large. A signal characterizer performing sequential FFT or FHT operations could be realized by a DSP (digital signal processor) with software such as assembler. However, in this case, large numbers of butterfly operations must be performed in series, rather than in parallel. Therefore, when a long serial signal is input, huge numbers of operations must be executed, requiring a very long time period.

This invention was conceived to overcome the above issues. Therefore, the object of the invention is to realize quick butterfly operations through parallel processes by rearranging the order of the input signal sequence or the output signal sequence, and to construct the signal characterizer using analog circuits.

It is another object of the invention to provide a signal characterizer which reduces power consumption by adapting capacitors as impedances in the analog circuit.

SUMMARY OF THE INVENTION

In order to achieve the above objects, the signal characterizer of the invention has a functional transformer, which serves as butterfly operation circuits. The functional transformation circuit is composed of adders, subtractors and multipliers for performing a prescribed functional transformation, such as FFT or FHT. A serial analog signal input into the signal characterizer is first converted into parallel discrete signals by an analog-type serial-to-parallel converter.

The converted signals are then supplied to the respective terminals of the butterfly operation circuits. The parallel signals output from the output terminals of the butterfly operation circuits are converted into a serial signal through a switching operation. The switching operation is controlled by a controller according to a prescribed process to rearrange the parallel signals from the respective outputs into a prescribed order.

Preferably, an analog shift register is used as the analog serial-to parallel-converter. The analog shift register preferably has the same number of sample holders as the number of parallel discrete signals. Each sample holder comprises a pair of switches connected in series which open and close contrary to each other by a clock, a pair of capacitors for holding the output signals from the respective switches, and buffers for outputting the signals held by the capacitors. The sample holders convert the serial analog signals input to the serially connected switches into parallel discrete signals in synchronization with the clock.

In another example of the signal characterizer of the invention, butterfly operation circuits are used as a functional transform circuit. The butterfly operation circuits are composed of adders, subtractors and multipliers to perform the prescribed functional transformation, such as FFT and FHT. An analog-type serial-to-parallel converter converts the input analog serial signal into parallel discrete signals while rearranging the signal in a prescribed order.

The rearranged signals are supplied to the respective input terminals of the butterfly operation circuits for the butterfly operations. The parallel signals output from the respective output terminals of the butterfly operation circuits are successively subjected to switching operations by the switch circuit for conversion into a serial signal. The rearrangement by the analog-type serial-to-parallel converter is controlled by a prescribed process. The parallel signals output from the output terminals of the butterfly operation circuit are converted to a serial signal in a prescribed order by a simple switching operation.

For the analog-type serial-to-parallel converter, an analog demultiplexer is preferably used. A switch supplies the serial analog signal to the parallel input terminals as parallel discrete signals in a prescribed order. A plurality of capacitors holds the respective signals which are output from the switch. A plurality of second switches synchronizes the signals held by the capacitors with a clock signal and outputs the synchronized signals. The serial input analog signal is converted into parallel signals arranged in a prescribed order, and the parallel signals are supplied to the respective input terminals of the signal characterizer.

In the signal characterizer of the invention, the adder in the functional transformer has an operational amplifier, a plurality of input impedance elements connected to the input of the operational amplifier, and a plurality of feedback impedance elements feeding the outputs of the operational amplifier to the inputs of the operational amplifier.

The subtractor of the functional transform circuit has a differential amplifier comprising an operational amplifier, a plurality of input impedance elements connected to the input of the operational amplifier, and a plurality of feedback impedance elements feeding the output of the operational amplifier to the input of the operational amplifier. Within both the adder and subtractor, the impedance elements are realized by capacitors having the same impedance.

The multiplier of the functional transform circuit is composed of a capacitor, an operational amplifier, a plurality of input impedance elements connected to the input of the operational amplifier, and a plurality of feedback impedance elements provided between the input and out output of the operational amplifier. The input impedance elements and the feedback impedance elements define the multiplication value.

The elements of the signal characterizer, i.e., the analog-type serial-to-parallel converter, adders, subtractors, and multipliers, are constructed using analog devices. Since capacitors are adopted as impedance elements, overall power consumption is reduced.

DESCRIPTION OF THE PREFERRED EMBODIMENT

1. First Embodiment

Figure 5:
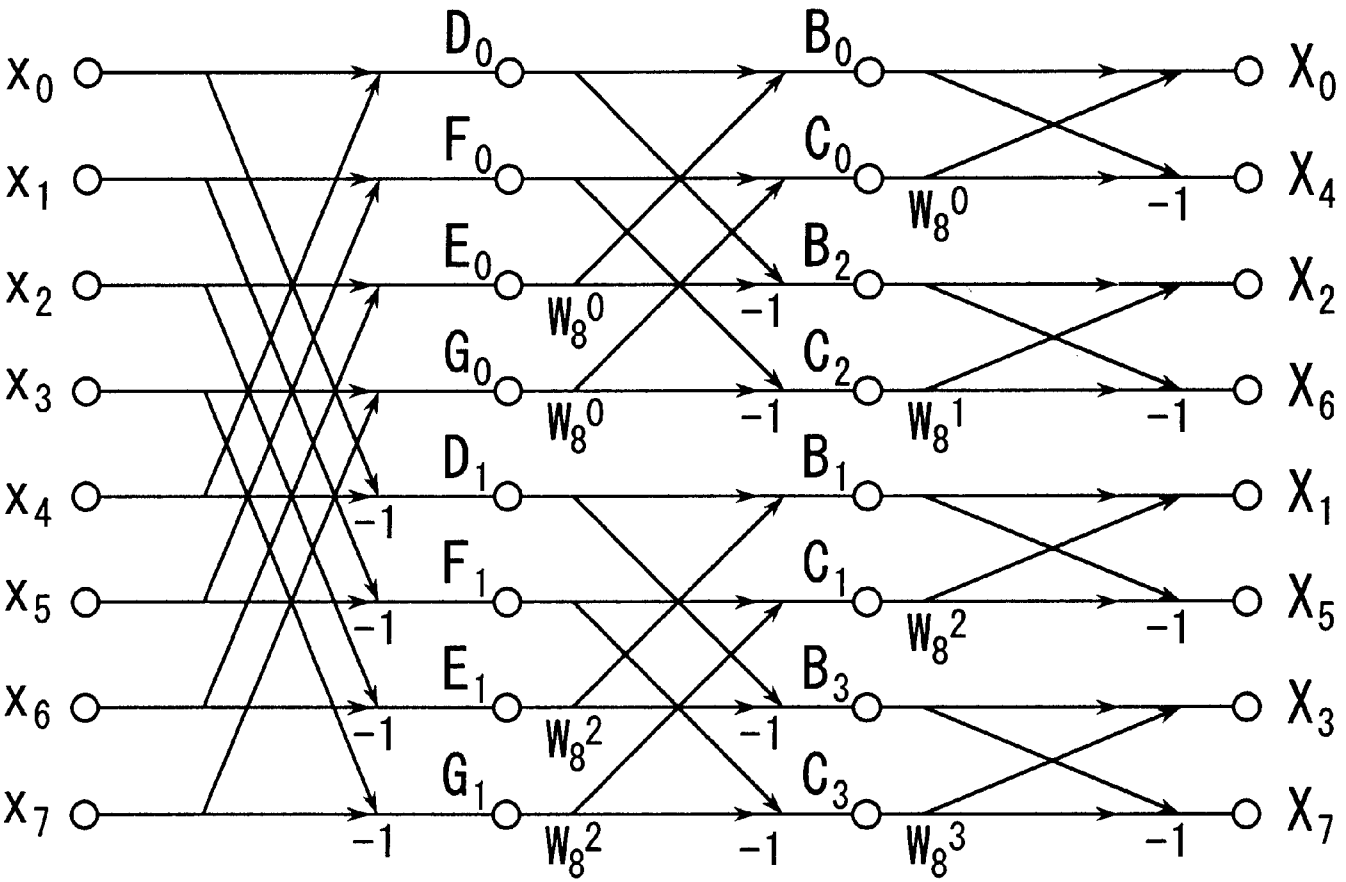
FIG. 5 PRIOR ART
FIG. 5 shows signal flow by another conventional 8-point FFT operation.

FIGS. 6 to 13 explain the signal characterizer of the present invention as applied to an 8-point FFT operation which realizes the signal flow of FIG. 5 in a more efficient manner.

Figure 6:
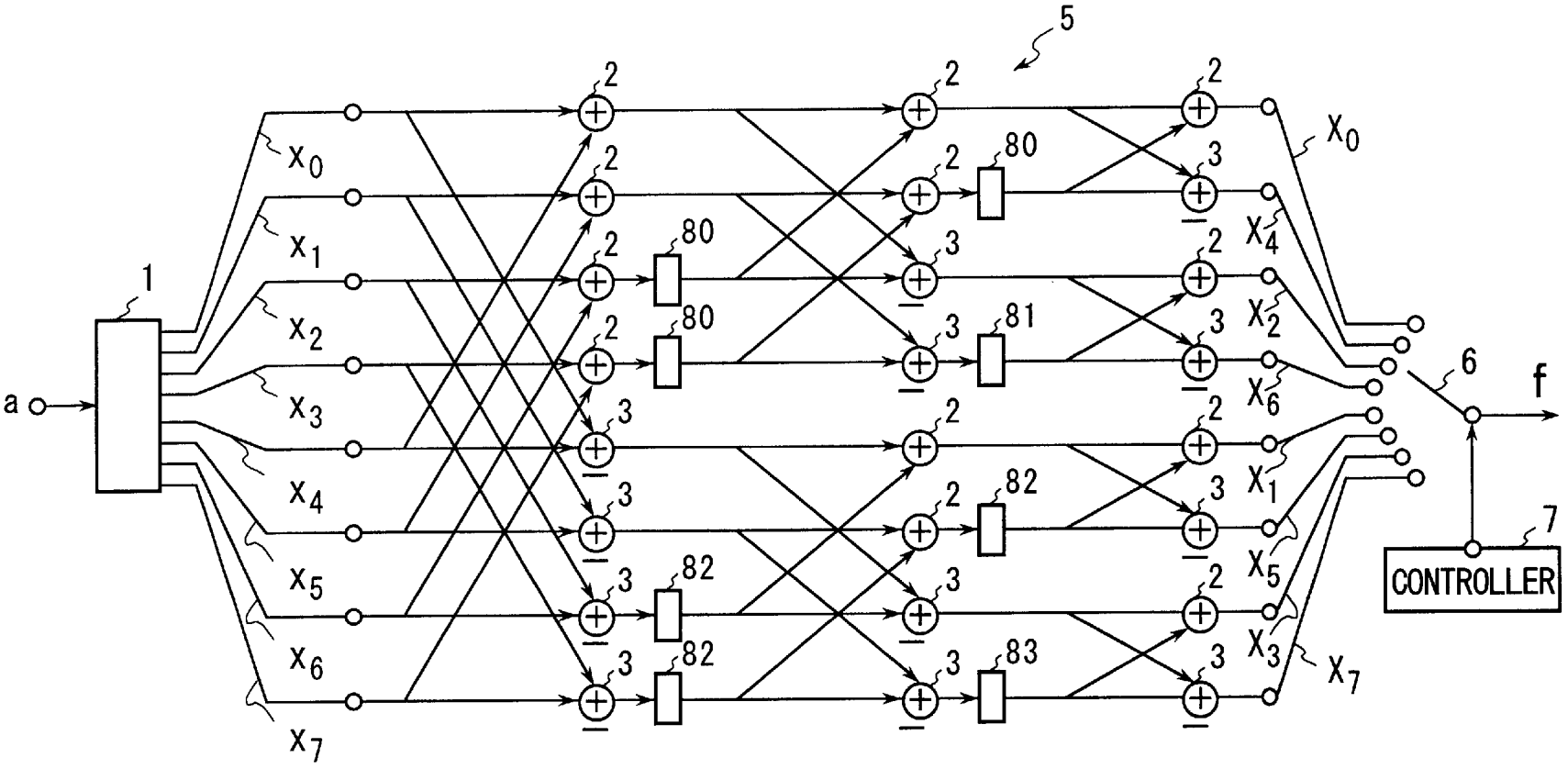
FIG. 6 is the signal characterizer of the first embodiment of the invention.

FIG. 6 is the signal characterizer of the invention. The signal characterizer includes an analog-type serial-to-parallel converter 1 for converting a serial input analog signal "a" into parallel discrete signals $x_0$ to $x_7$. The signal characterizer also includes a functional transformer 5 which functions as butterfly operation circuits, containing a plurality of adders 2, subtractors 3 and multipliers 80, 81, 82 and 83. The outputs of the functional transformer are discrete signals arranged as $X_0$, $X_4$, $X_2$, $X_6$, $X_1$, $X_5$, $X_3$ and $X_7$ in that order. The signal characterizer further includes a switch 6 for converting the discrete signals $X_0$, $X_4$, $X_2$, $X_6$, $X_1$, $X_5$, $X_3$ and $X_7$ to a serial signal "f" through a switching operation.

Output controller 7 controls output switch 6 to rearrange the discrete signals $X_0$, $X_4$, $X_2$, $X_6$, $X_1$, $X_5$, $X_3$ and $X_7$ into a serial signal in the order of $X_0$, $X_1$, $X_2$, $X_3$, $X_4$, $X_5$, $X_6$ and $X_7$. The signal characterizer realizes the signal flow of FIG. 5. In the prior art example of FIG. 5 (8-point FFT), the input signals $X_0$ to $X_7$ are output from the butterfly operation circuits in the order of $X_0$, $X_4$, $X_2$, $X_6$, $X_1$, $X_5$, $X_3$ and $X_7$. The signal characterizer of the invention rearranges the parallel output signals in the order of $X_0$ to $X_7$ using a switch.

Figure 7:
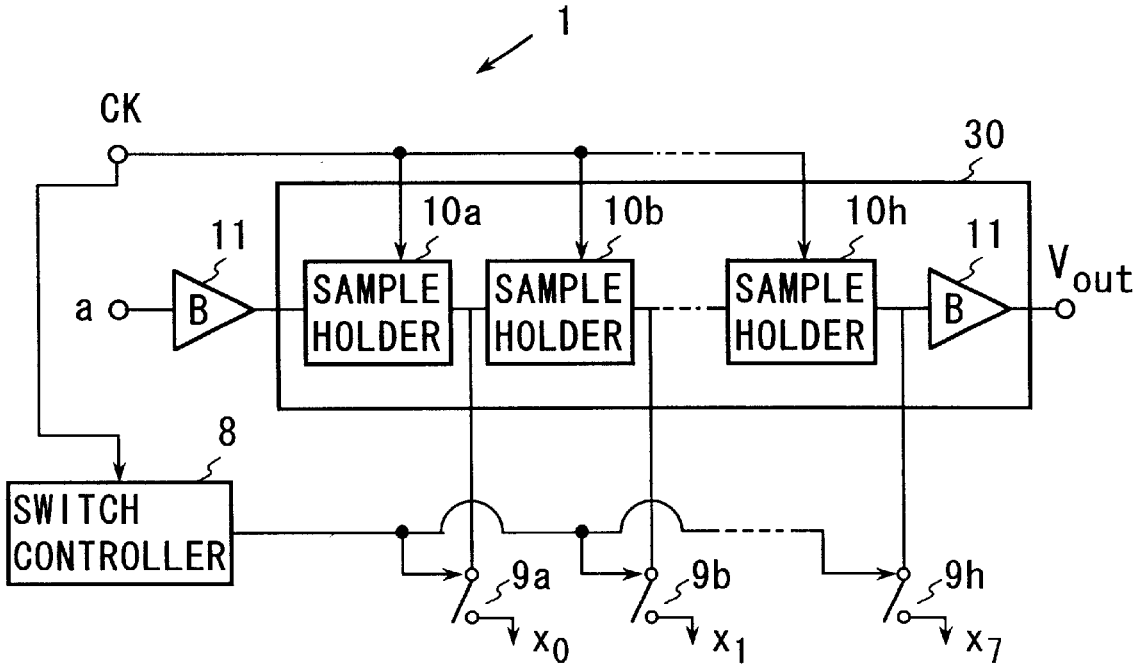
FIG. 7 is the analog shift register of the analog-type serial-to-parallel converter according to the present invention.

FIG. 7 shows the analog-type serial-to-parallel converter 1 having an analog shift register 30. The analog shift register 30 comprises eight (8) stages of sample holders 10*a* through 10*h* (comprehensively referred to as 10) connected in series and buffers 11 connected to the input side and output side of the serially connected sample holders 10*a* to 10*h*. The input side and output side buffers 11 can be the input buffer and output buffer of the semiconductor chip realizing the signal characterizer. The number of sample holders 10*a* to 10*h* is equal to the number of parallel discrete signals $x_0$ to $x_7$.

The sample holders 10*a* through 10*h* sample the serial analog signal "a" under the control of clock signal CK and convert the sampled signals to parallel discrete signals $x_0$ to $x_7$. More particularly, the first sample holder 10*a* samples the serial analog signal "a" through the input side buffer 11 and outputs signal $x_0$ in synchronization with the rising edge of the clock signal CK. The second sample holder 10*b* samples the output $x_0$ of the first sample holder 10*a* in synchronization with the rising edge of clock CK and outputs $x_1$. Thus, the signal is shifted by one clock at each stage and output in parallel.

The serial-to-parallel converter 1 also has a switch controller 8 for counting the rising of clock CK and outputting a switch control signal and eight switches 9*a* through 9*h* which open and close in response to the switch control signal. The signals $x_0$ to $x_7$ are supplied to the switches 9*a–h* from the respective sample holders 10*a–h* and output to the butterfly operation circuits at the same time by turning on the switches 9*a–h*. Namely, the switch controller 8 adds "1" to the internal counter value in synchronism with the rising of clock signal CK and compares the result with $2^N-1$ ($2^N$ is the number of output signals "x", which is eight in this example).

When internal counter value and the clock CK signal value are equal, a control signal becomes active (high) to close the switches 9*a–h*, and when the two values are different, the control signal becomes inactive (low) to open the switches 9*a–h*. The internal counter of the switch controller 8 is reset to "0" every time the addition result becomes $2^N$ (8 in this example), and the same operation repeats. Accordingly, all of the switches 9*a–h* are turned on every $2^N$ rising edges of the clock CK (8 in this embodiment) rising edges to collectively supply the outputs $x_0$ to $x_7$ from the sample holders 10*a–h* to the butterfly operation circuits.

Figure 8:
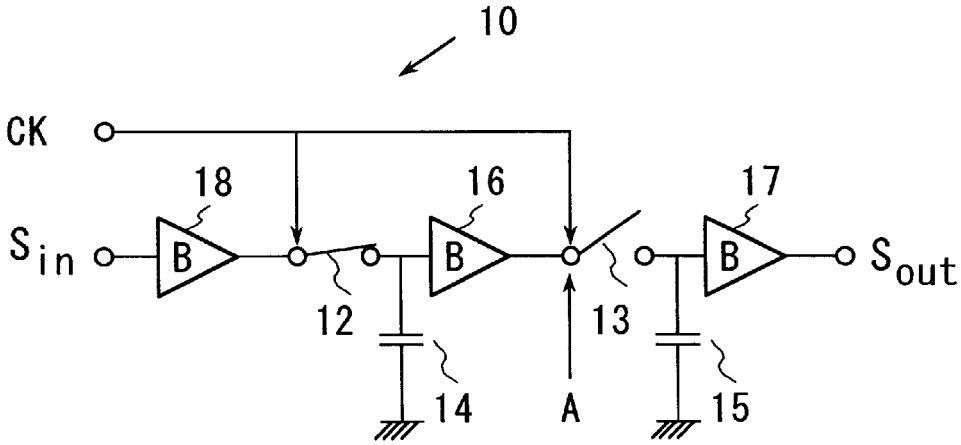
FIG. 8 is the sample holder of the characterizer.

FIG. 8 illustrates the operation of a sample holder 10. A pair of switches 12 and 13 close and open contrary to each other in response to the clock signal CK. Namely, when the clock signal CK is low, switch 12 closes and switch 13 opens. Conversely, when the clock signal CK is high, switch 12 opens and switch 13 closes. A pair of capacitors 14 and 15 hold the output signals from switches 12 and 13, respectively. A pair of buffers 16 and 17 output the signals held by capacitors 14 and 15, respectively. A buffer 18 is connected to the input side of the pair of switches.

The signal which is input to the switches 12 and 13 through the input buffer 18 is converted to a discrete signal ($x_0$, $x_2$, . . . ,or $x_7$) in synchronism with the clock signal CK. The signal $S_{in}$ (input signal "a" or signal $x_n$ from the previous stage) is input, for example, to the sample holder 10*a* through the input buffer 18 and transferred to the capacitor 14 when the clock signal CK is low (switch 12 is closed). When the clock signal CK becomes high, switch 12 opens and the capacitor 14 holds the same signal level. The signal level is further supplied to the capacitor 15 through the buffer 16 and switch 13 while the clock CK is high and switch 13 is closed. The capacitor 15 holds the same signal level when the clock signal CK is low and switch 13 is open. The signal held by the capacitor 15 is output as a signal $S_{out}$ ($x_n$ in FIG. 7) to a later stage sample holder, 10*b* for example, through a buffer 17.

Figure 9A:
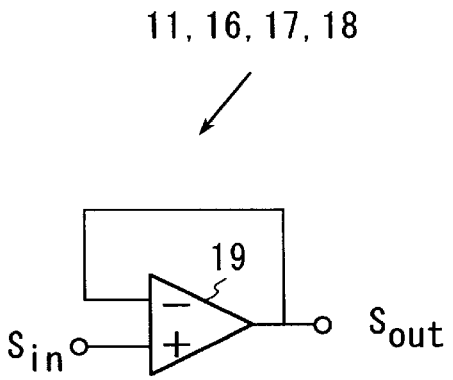
FIGS. 9A and 9B are examples of the buffer of the characterizer.
Figure 9B:
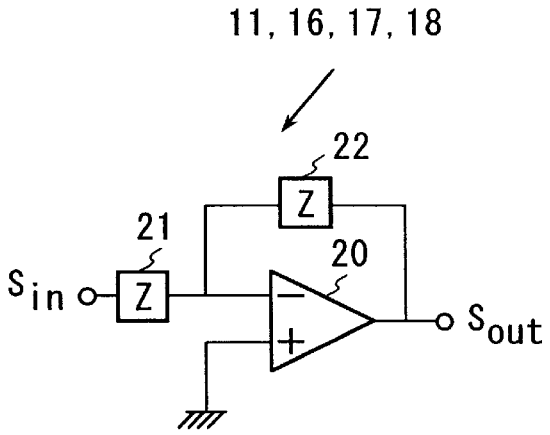

FIGS. 9A and 9B show examples of the buffers 11, 16, 17 and 18. The buffer shown in FIG. 9A is a voltage follower using an operational amplifier 19 whose output is directly fed back to its negative input. The buffer shown in FIG. 9B is composed of an operational amplifier 20, an input impedance element 21 connected to the negative input of the operational amplifier and a feedback impedance element 22 provided between the output and negative input of the operational amplifier.

Figure 10:
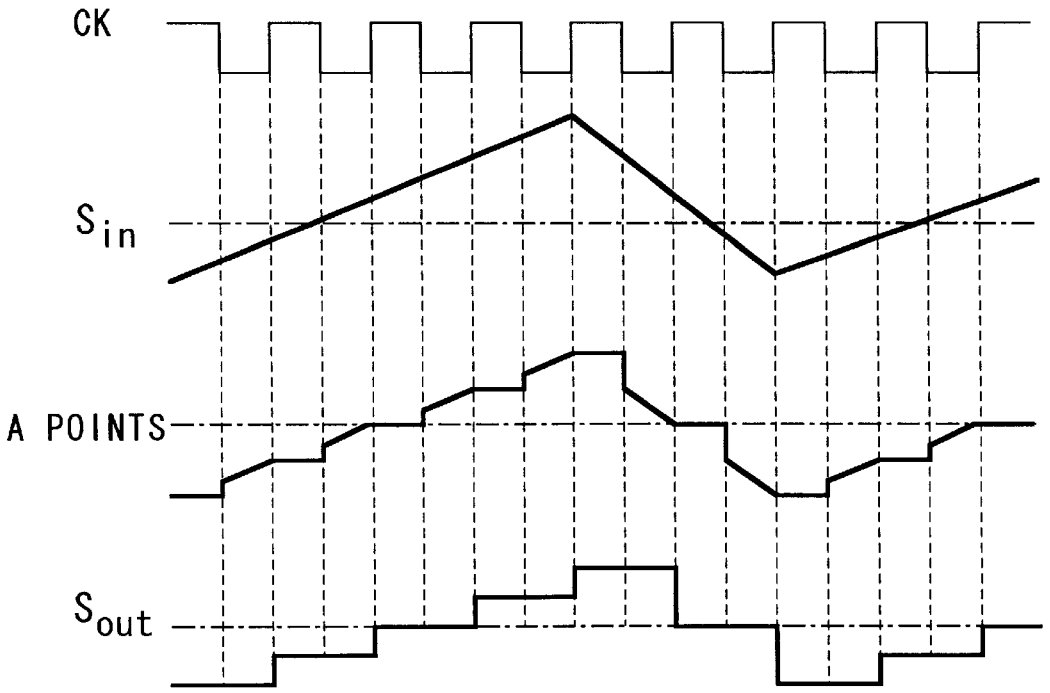
FIG. 10 is an operational time chart of the analog-type serial-to-parallel converter according to the present invention.

FIG. 10 is a timing chart of one of the sample holders 10*a–h*. Based on the aforementioned operations of the sample holders 10*a–h,* input signal $S_{in}$ is shifted by one clock and sampled at each sample holder 10*a–h*, thereby converting the analog input signal $S_{in}$ into a discrete output signal $S_{out}$.

Figure 11:
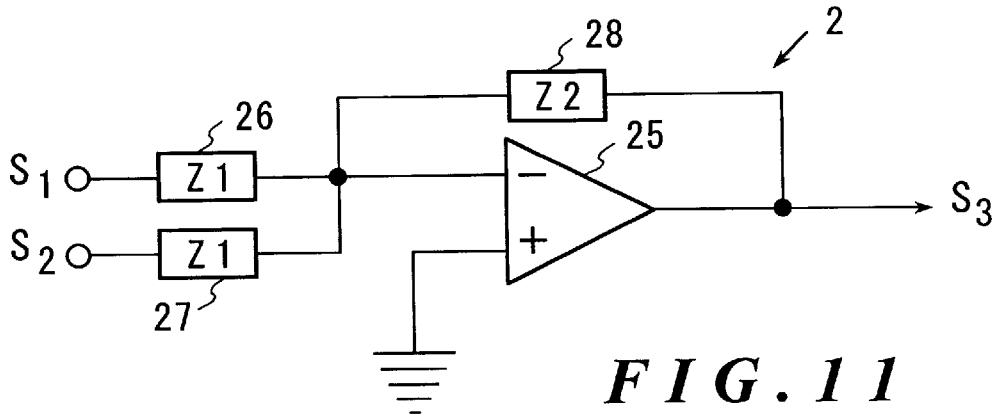
FIG. 11 is an example of the adder of the characterizer.

FIG. 11 shows the adder 2 of the butterfly operation circuit. The adder 2 includes an operational amplifier 25 whose positive input is grounded, a pair of impedance elements 26, 27 connected to the negative input of the operational amplifier 25, and a feedback impedance element 28 provided between the output and the negative input of the operational amplifier 25. The impedance level Z1 of the impedance elements 26, 27 is equal to the impedance level Z2 of the feedback impedance element 28. When a pair of input signals s1 and s2 (i.e., a pair of signals used for the butterfly operation) are input through the respective impedance elements 26, 27 into the operational amplifier 25, the sum of the signals s1 and s2 are output as a signal s3.

Figure 12:
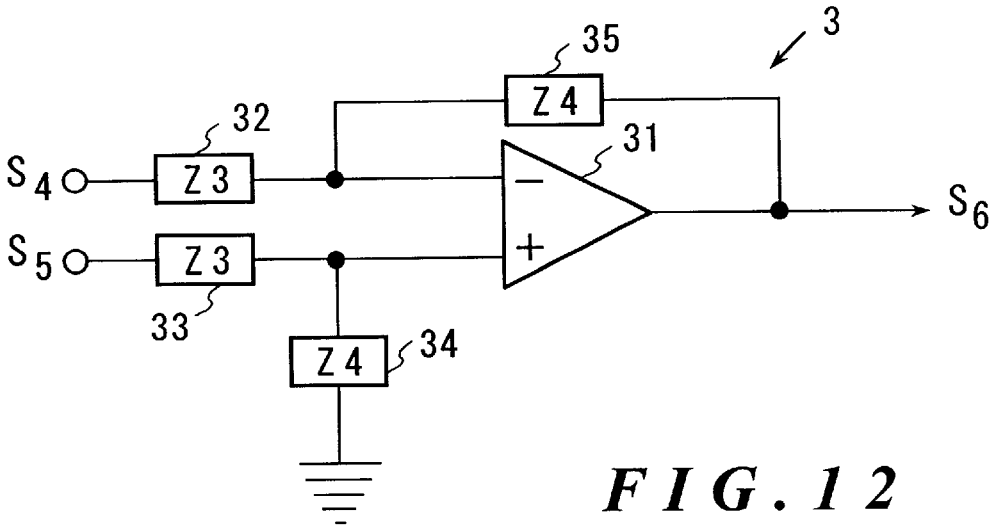
FIG. 12 is an example of the subtractor of the characterizer.

FIG. 12 shows the subtractor 3. The subtractor 3 comprises a differential operational amplifier 31 and impedance elements 32 and 33 connected to the negative and positive inputs of the operational amplifier 31, respectively. An impedance element 34 grounds the positive input of the operational amplifier 31. A feedback impedance 35 is provided between the output and the negative input of the operational amplifier 31.

The impedance level Z3 of the impedance elements 32, 33 is equal to the impedance level Z4 of the impedance element 35. When a pair of input signals s4, s5 (i.e., a pair of signals for the butterfly operation) are input through the respective impedance elements 32, 33 to the operational amplifier 31, the difference between the signals s4 and s5 is output as a signal s6.

Figure 13:
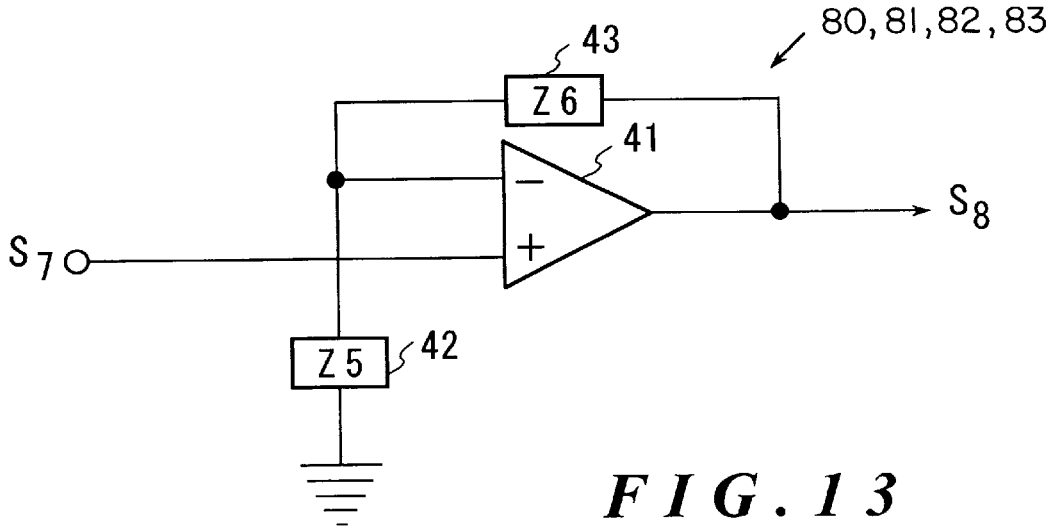
FIG. 13 is an example of the multiplier of the characterizer.

FIG. 13 illustrates multipliers 80, 81, 82 and 83. The multipliers 80, 81, 82 and 83 each contain a non-inverting operational amplifier 41, an impedance element 42 grounding the negative input of the operational amplifier 41, and a feedback impedance element 43 connected between the output and the negative input of the operational amplifier 41. Suppose $V_1$ and $V_0$ are the voltages of the input signal s7 and output signal s8 (signal in the butterfly operation), respectively, and Z5 and Z6 are the impedance levels of the impedance elements 42 and 43 respectively. Then the relationship between the input signal s7 and the output signal s8 is expressed as follows:

$$V_0=[1+(Z6/Z5)]V_1 \quad (7)$$

In this embodiment, the value "1+(Z6/Z5)" is set to a predetermined rotational factor $W_8^k$. Therefore, the level of the output signal s8 is a product of the level of the input signal s7 and the rotational factor $W_8^k$. The values of the rotational factors are set to $W_8^0$, $W_8^1$, $W_8^2$ and $W_8^3$ in the multipliers 80, 81, 82 and 83, respectively, so that the operation of the butterfly circuits are equivalent to the signal flow of FIG. 5.

Because the value of the rotational factor is defined by the ratio of the impedance levels (Z6/Z5), the impedances of the impedance elements 42 and 43 do not need to have accurate numerical values as long as the ratio of the impedances is maintained. Accordingly, the multipliers can be readily constructed by relatively inexpensive impedance elements.

Output switch 6 is composed of transistors which operate in response to the control signal. In this embodiment, the output switch 6 connects 8 parallel signals $X_0$, $X_4$, $X_2$, $X_6$, $X_1$, $X_5$, $X_3$ and $X_7$ to the serial output terminal in the prescribed order of $X_0$, $X_1$, $X_2$, $X_3$, $X_4$, $X_5$, $X_6$ and $X_7$ to convert the parallel signals to a serial signal f. The output controller 7 is programmed in advance to execute the switching operation. The output controller 7 outputs a control signal to the output switch 6 according to the program, thereby rearranging the order of the parallel signals and producing a serial signal arranged in the predetermined order.

The signal characterizer of this embodiment is constructed by an analog circuit. Impedance elements are used in the analog-type serial-to-parallel converter 1, adders 2, subtractors 3, multipliers 80, 81, 82, 83, and buffers 11, 16, 17, 18. The impedance elements contain capacitors, thereby suppressing heat conversion and reducing power consumption.

In the signal characterizer of the invention, upon receiving an analog signal "a", the analog-type serial-to-parallel converter 1 converts the analog signal "a" into parallel discrete signals $x_0$ to $x_7$. The functional transformer 5 applies butterfly operations to the parallel signals to compute the FFT. This functional transformation is executed along with the signal flow of FIG. 5. The switch 6 switches over the signals under the control of the controller 7 to rearrange the parallel signals $X_0$, $X_4$, $X_2$, $X_6$, $X_1$, $X_5$, $X_3$ and $X_7$ output from the functional transformer 5 in this disorganized order into a serial signal "f" consisting of well-ordered serial signals, $X_0$, $X_1$, $X_2$, $X_3$, $X_4$, $X_5$, $X_6$ and $X_7$.

Thus, the signal characterizer converts a serial signal input in the time domain to a signal arranged in the frequency domain through butterfly operations in analog circuits.

2. Second Embodiment

Figure 14:
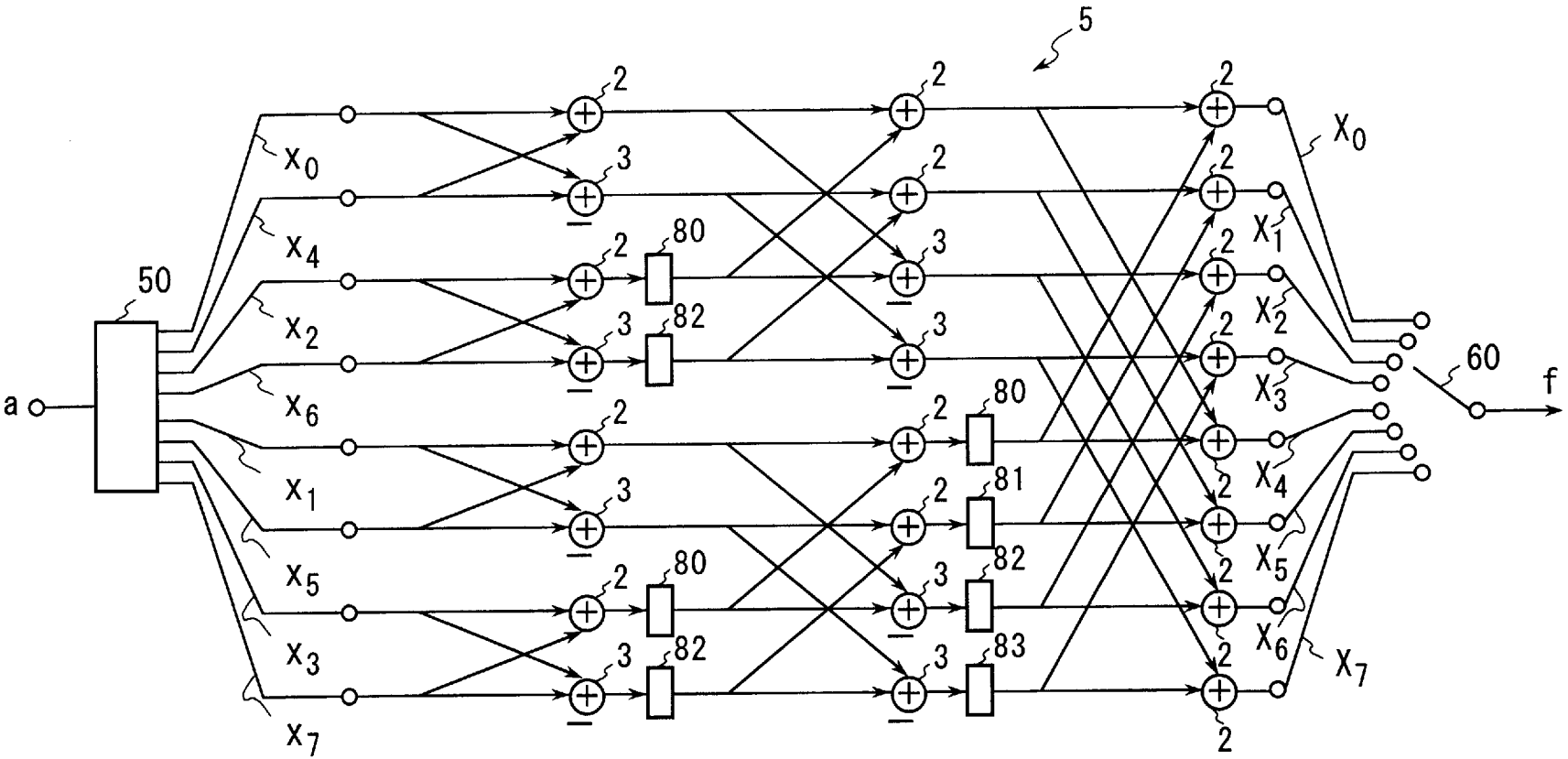
FIG. 14 is the signal characterizer according to the second embodiment of the invention.
Figure 15:
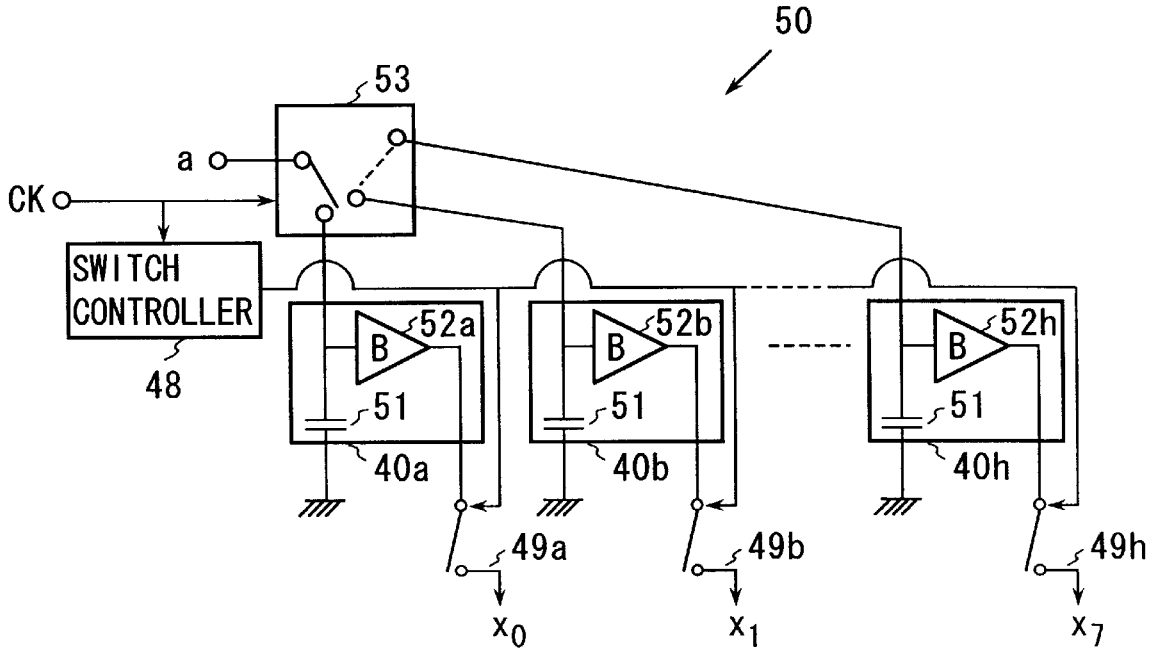
FIG. 15 is the analog demultiplexer of the second embodiment.
Figure 16:
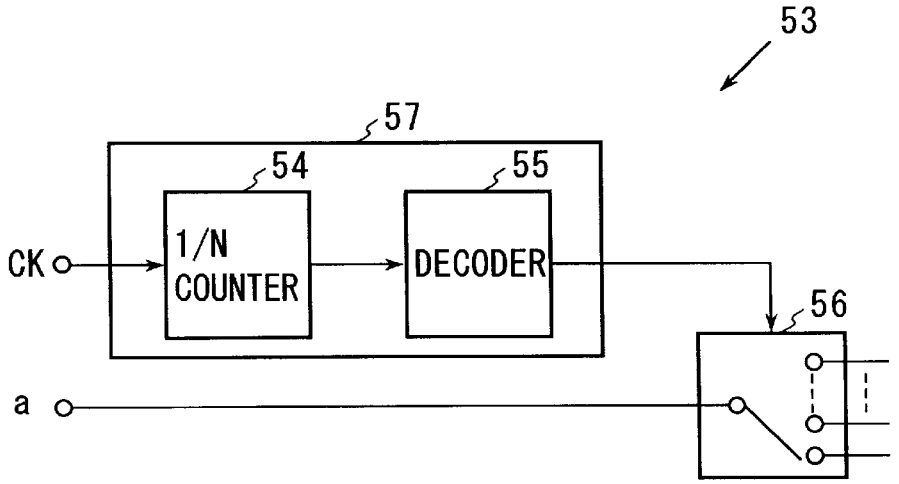
FIG. 16 is the switch controller of the second embodiment.

FIGS. 14 to 16 explain the signal characterizer used for an 8-point FFT operation according to a second embodiment. This embodiment realizes the signal flow of FIG. 4. The same elements as the first embodiment bear the same reference numerals, and their explanations will be omitted.

FIG. 14 is the signal characterizer of the second embodiment. The signal characterizer includes an analog-type serial-to-parallel converter 50 composed of an analog demultiplexer. This differs from the first embodiment in which the analog-type serial-to-parallel converter 1 is composed of an analog shift register. Also, the butterfly operation circuits of the functional transformer 5 are adapted to execute the butterfly operations of FIG. 4. The output switch 6 and switch output controller 7 combination of the first embodiment is replaced by a simple switch 60 which successively connects to the parallel output terminals. Thus, the signal characterizer emulates the signal flow of FIG. 4 as a whole.

Figure 1:
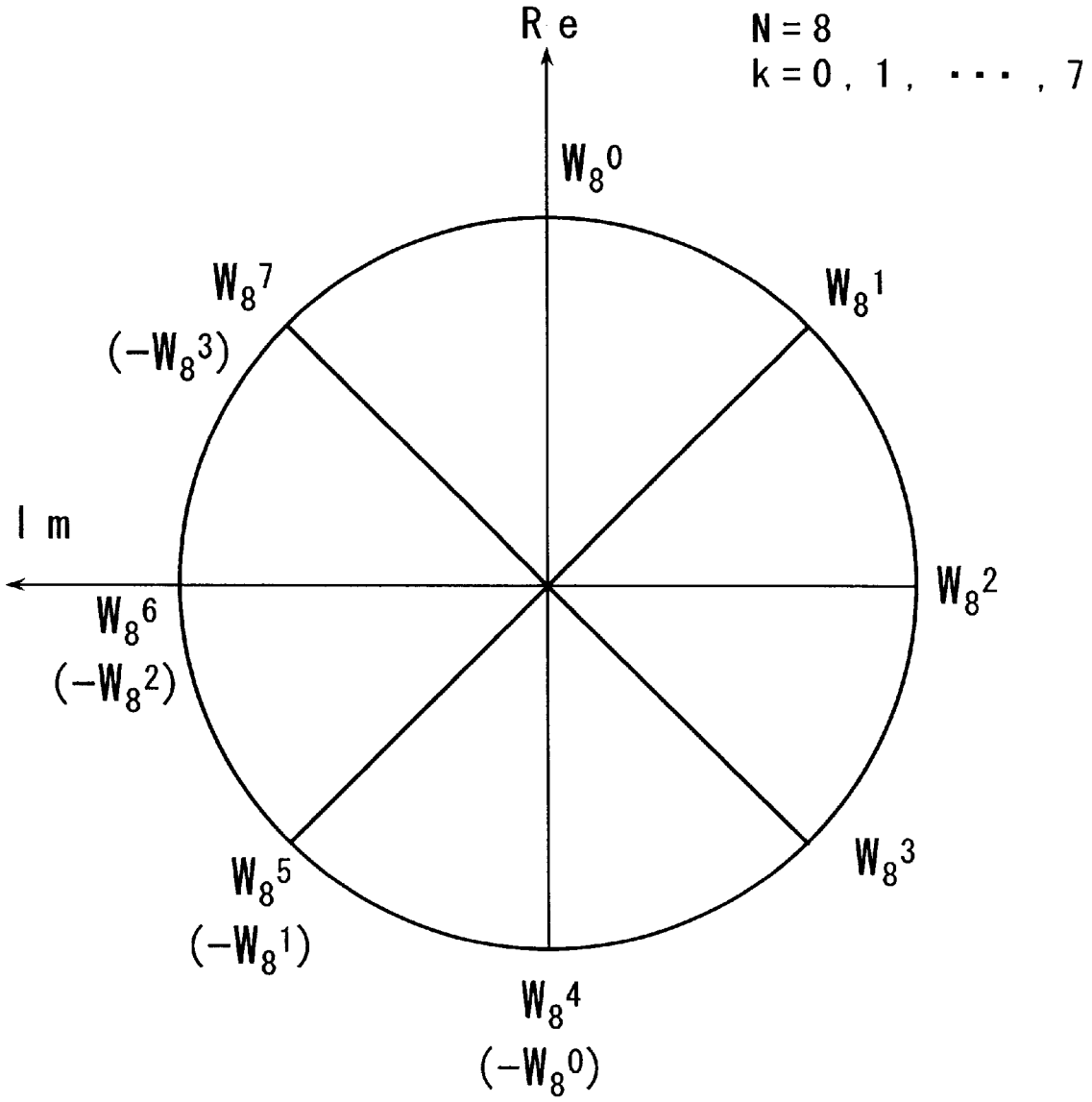
FIG. 1 PRIOR ART
FIG. 1 illustrates the characteristics of a rotational factor.
Figure 2:
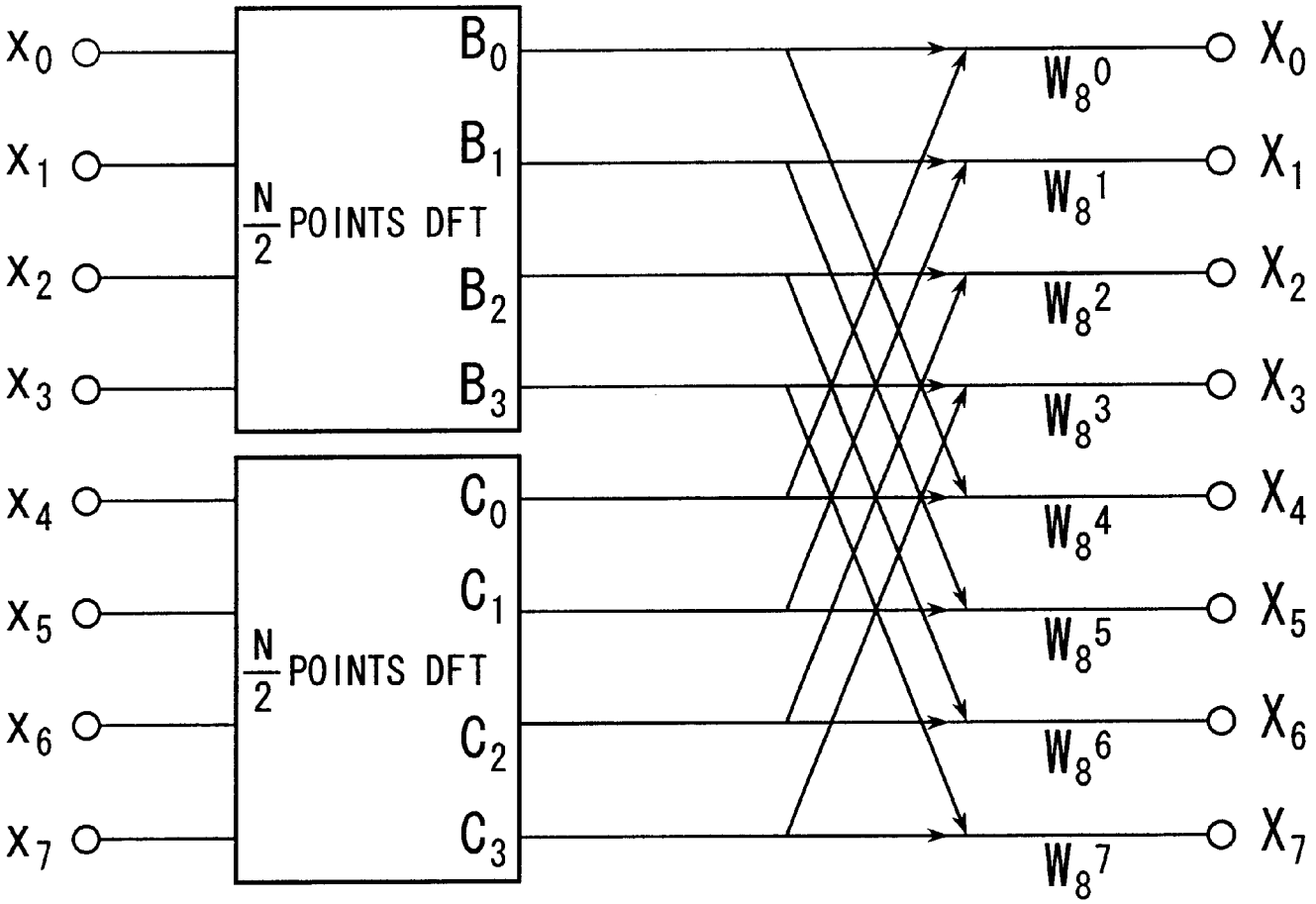
FIG. 2 PRIOR ART
FIG. 2 shows signal flow by a conventional 4-point DFT operation.
Figure 3:
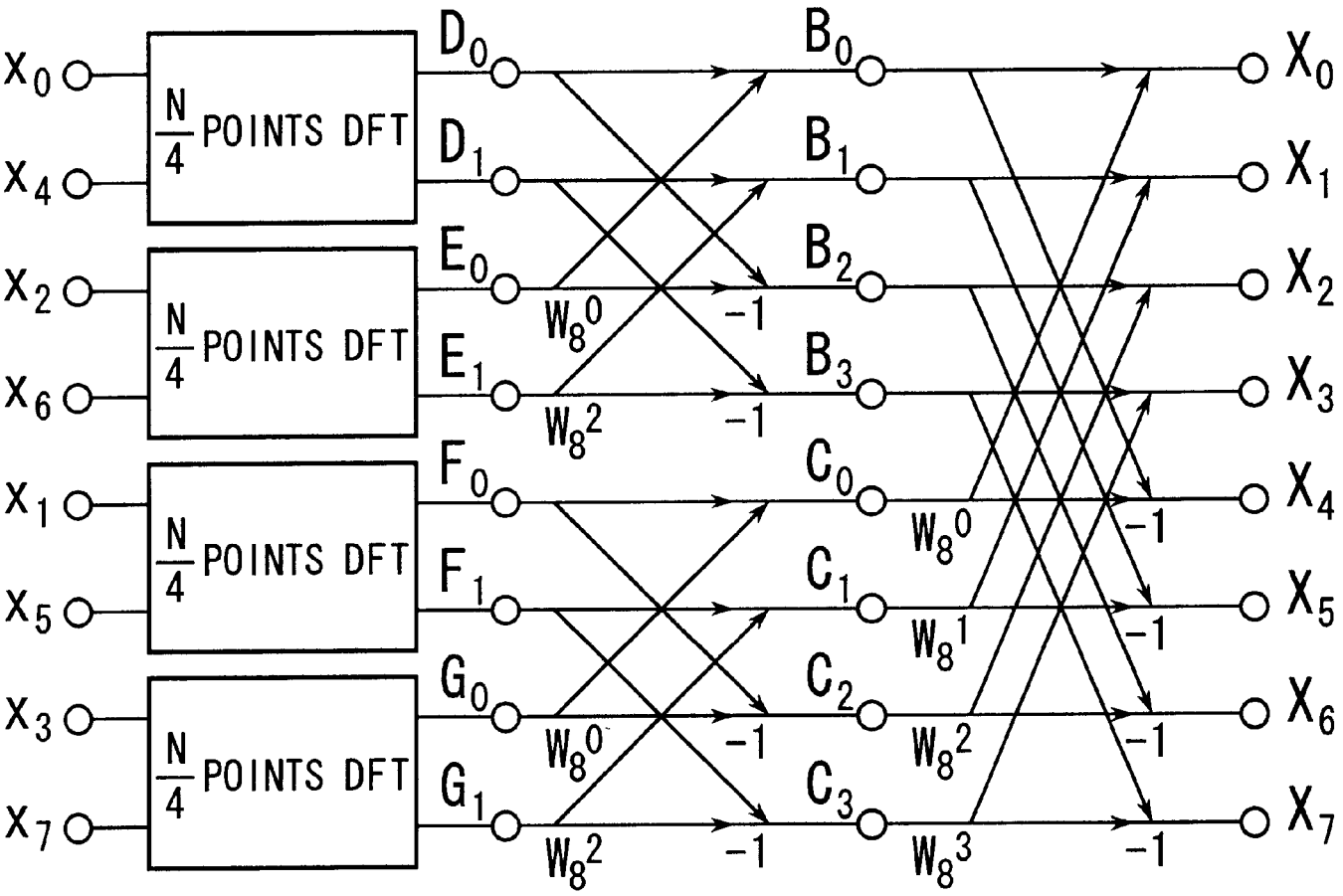
FIG. 3 PRIOR ART
FIG. 3 shows signal flow by a conventional 2-point DFT operation.
Figure 4:
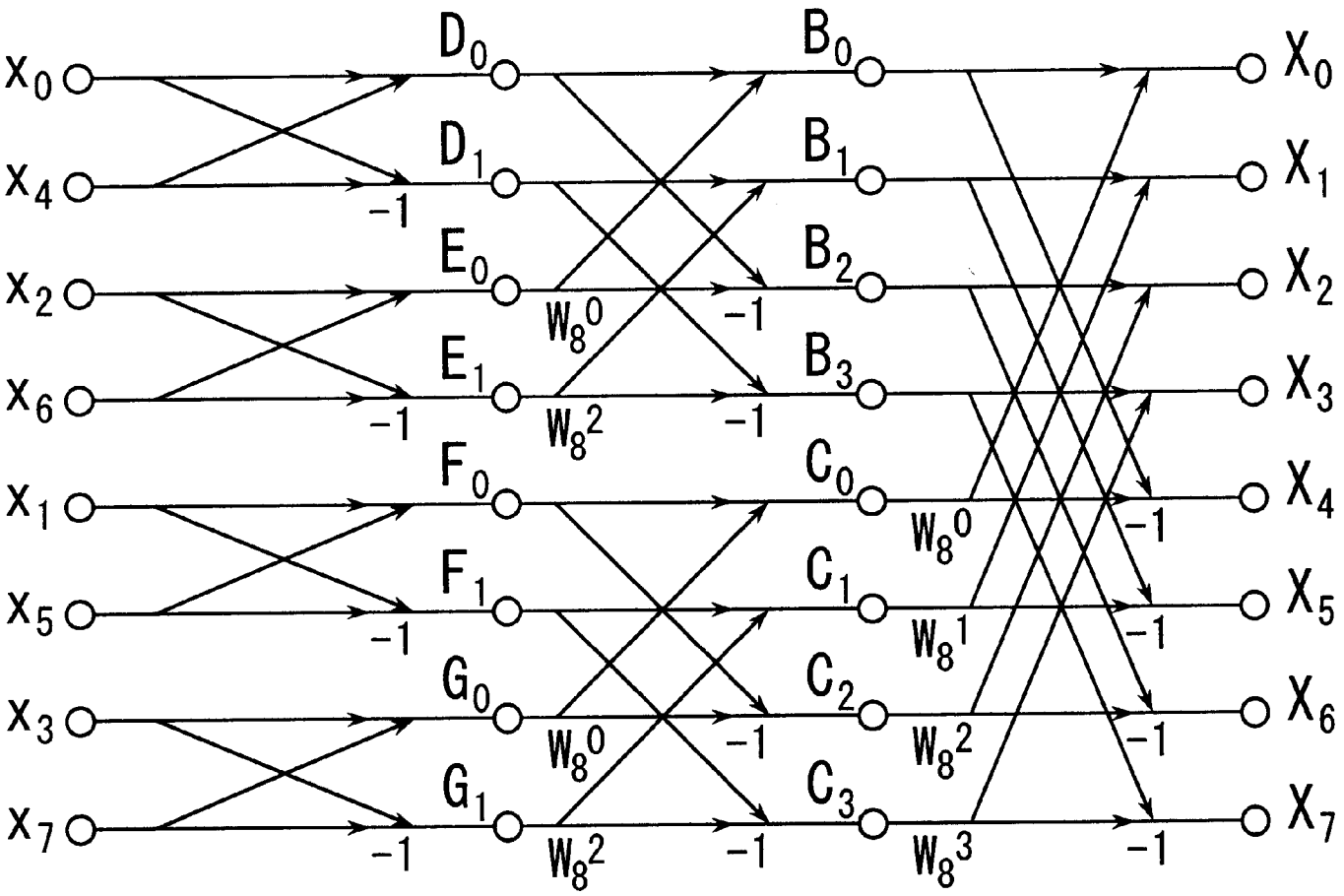
FIG. 4 PRIOR ART
FIG. 4 shows signal flow by a conventional 8-point FFT operation.

If the parallel input signals were arranged as $x_0$, $x_1$, . . . , $x_7$, the parallel output signals would not be arranged the correctly and should not be output to the serial output terminal in that incorrect order. However, since the parallel input signals are previously arranged as $x_0$, $x_4$, $x_2$, $x_6$, $x_1$, $x_5$, $x_3$ and $x_7$, as shown in FIG. 4, the parallel output signals are arranged as $X_0$, $X_1$, . . . , $X_7$ and can be output to the serial output terminal in the correct order by simply switching and supplying the output signals sequentially.

FIG. 15 shows the analog demultiplexer 50 comprising a plurality of sample holders 40*a–h*. The number of sample holders 40*a–h* is equal to the number of parallel discrete signals $x_0$ to $x_7$. Each sample holder 40 includes a grounded capacitor 51 and a buffer 52 for outputting the signal held by the capacitor 51. The analog demultiplexer 50 further comprises a switch unit 53 which connects to the sample holders 40*a–h* in turn at a predetermined timing to supply the input signal "a" to the respective sample holders 40*a–h*.

FIG. 16 is the switch unit 53 having a controller 57 and a switch 56. The controller 57 has a 1/N (1/8 in this embodiment) counter 54 and a decoder 55, and controls the switch 56. The clock signal CK is supplied to the decoder 55 through the 1/N counter 54. The decoder counts the 1/N clock signal supplied by the 1/N counter 54, decodes the counted value, and outputs a signal controlling the switch 56. The switch 56 supplies the input analog signal "a" to the respective sample holders 40*a–h* while rearranging and converting the serial input signal into parallel discrete signals arranged in the order of $x_0$, $x_4$, $x_2$, $x_6$, $x_1$, $x_5$, $x_3$, and $x_7$. The sample holders 40*a–h* hold the parallel discrete signals in turn according to the switching operation. The switch controller 48 further controls the switches 49 respectively connected to the output of the buffers 52 such that the parallel discrete signals $x_0$, $x_1$, . . . , $x_7$ are output to the functional transformer 5 at one time after the last stage sample holder 40 holds the discrete signal $x_7$.

The switch controller 48 controls the switches 49*a–h* in the same way as the switch controller 8 controls the switches 9 in FIG. 7. The switch controller 48 outputs a control signal for closing the switches 49 when the clock signal CK rises $2^N-1$ times. Here, $2^N$ is the number of output signals $x_n$, 8 in this example. As a result, all of the switches 49 close every $2^N$ rising edges (8 in this example) of the clock signal CK to output the signals $x_0$ to $x_7$ from the respective sample holders 40*a–h* to the butterfly operation circuits together.

The output switch 60 is provided on the output side of the functional transformer 5 and connects with the parallel output terminals of the transformer 5 successively at predetermined clock timings to convert the parallel discrete signals arranged as $X_0$, $X_1$, $X_2$, $X_3$, $X_4$, $X_5$, $X_6$ and $X_7$ at the parallel output terminals to a serial signal "f".

In the second embodiment, when the analog signal "a" is input to the signal characterizer, the analog-type serial-to-parallel converter 50 converts the serial analog signal "a" to parallel discrete signals arranged as $x_0$, $x_4$, $x_2$, $x_6$, $x_1$, $x_5$, $x_3$ and $x_7$. The converted signals are then subjected to FFT operation through the parallel butterfly operations in the functional transformer 5. This is the functional transformation along with the signal flow of FIG. 4. As a result of the butterfly operations, parallel analog signals arranged as $X_0$, $X_1$, $X_2$, $X_3$, $X_4$, $X_5$, $X_6$ and $X_7$ are output from the parallel output terminals of the functional transformer 5. These well-ordered, parallel analog signals are converted to a serial signal "f" through the sequential switching operation of the output switch 60.

Although the present invention was explained in accordance with the preferred embodiments, many modifications can be made to the embodiments without leaving from the scope of the invention. Therefore, the scope of the invention is not limited by those embodiments as is clear from the following claims.

For example, although 8-point FFT is exemplified in the embodiments, a $2^n$-FFT signal characterizer (n being any natural number) can be realized in the same manner to process any $2^n$ input signals. Moreover, this invention can be applied to other types of signal characterizers performing, for example, FHT without losing the effects and advantages of the invention.

The signal characterizer of the invention is preferably constructed as a one-chip semiconductor device, which is broadly utilized in, for example, image processing and communication signal processing.

The signal characterizer of the invention is constructed with analog circuits. The order of the signal input to the functional transformer, and the order of the signal output from the functional transformer are rearranged so that the butterfly operations are efficiently applied. Accordingly, even if the serial input signal is large, butterfly operations are promptly performed in parallel.

Furthermore, since the signal characterizer of the invention adopts capacitors as the impedance of the analog circuits, power consumption is efficiently reduced.

What is claimed is:

1. A signal characterizer applying a functional transformation to a serial analog signal, comprising:

an analog-type serial-to-parallel converter which converts the serial analog signal into a plurality of discrete parallel signals;

a functional transformer, coupled to the serial-to-parallel converter, having a plurality of parallel input terminals which input the discrete parallel signals, a butterfly operation circuit which transforms the discrete parallel signals into a plurality of transformed signals according to a predetermined functional transformation, and a plurality of parallel output terminals, equal in number to the number of parallel input terminals, which output the transformed signals;

an output switch, having a serial output terminal, which supplies the transformed signals from the parallel output terminals to the serial output terminal; and an output switch controller which generates an output switch control signal to control the output switch in order to output the transformed signals to the serial output terminal according to a predetermined order, wherein, the analog-type serial-to-parallel converter contains an analog shift register having a plurality of sample holders connected in series, and each of the sample holders includes an output terminal connected to one of the parallel input terminals.

2. The signal characterizer of claim 1, wherein each of the sample holders further includes a pair of switches connected in series, a pair of capacitors which hold signals outputted from the pair of switches, and a pair of buffers which the signals held by the pair of capacitors such that the pair of switches are configured to open and close in response to a clock signal supplied to the sample holders in order to synchronize the analog-type serial-to-parallel converter with the clock signal.

3. The signal characterizer of claim 2, wherein each switch in the pair of switches is configured to open and close contrary to the other switch in response to the clock signal.

4. The signal characterizer of claim 1, wherein the butterfly operation circuit contains an adder including a capacitor, an operational amplifier having an amplifier input and an amplifier output, a plurality of input impedance elements connected to the amplifier input, and a feedback impedance element, equal to the input impedance elements and disposed between the amplifier output and the amplifier input.

5. The signal characterizer of claim 1, wherein the butterfly operation circuit contains a subtractor including a differential operational amplifier having an amplifier input and an amplifier output, a plurality of input impedance elements connected to the amplifier input, and a feedback impedance element provided between the amplifier input and the amplifier output.

6. The signal characterizer of claim 5, wherein the impedances of the input impedance elements are equal to the impedance of the feedback impedance element.

7. The signal characterizer of claim 1, wherein the butterfly operation circuit contains a multiplier including a capacitor, an operational amplifier having an amplifier input and an amplifier output, input impedance elements connected to the amplifier input, and a feedback impedance element provided between the amplifier output and the amplifier input.

8. The signal characterizer of claim 7, wherein the impedances of the input impedance elements and the feedback impedance element define a multiplication value of the multiplier.

9. A signal characterizer applying a functional transformation to a serial analog signal, comprising:

an analog-type serial-to-parallel converter which coverts the serial analog signal into a plurality of discrete parallel signals arranged in predetermined order;

a functional transformer, coupled to the serial-to-parallel converter, having a plurality of parallel input terminals which input the discrete parallel signals, a butterfly operation circuit which transforms the discrete parallel signals into a plurality of transformed signals according to a predetermined functional transformation, and a plurality of parallel output terminals, equal in number to the number of parallel input terminals, which output the transformed signals; and an output switch, having a serial output terminal which supplies the transformed signals from the parallel output terminals to the serial output terminal sequentially wherein, the analog-type serial-to-parallel converter contains an analog demultiplexer which includes a first input switch and a plurality of capacitors, the first input switch inputs the serial analog signal deriving a plurality of analog input signals, and supplies the analog input signals to a plurality of capacitors according to a predetermined order to store the analog input signals.

10. The signal characterizer of claim 9, wherein the analog demultiplexer further includes a plurality of buffers, having buffer outputs, which buffer respective analog input signals stored in the capacitors and output the stored analog input signals to the buffer outputs, and a second input switch connecting the buffer outputs to the parallel input terminals.

11. The signal characterizer of claim 10, wherein the second input switch connects the buffer outputs to the input terminals, respectively, at substantially the same time.

12. The signal characterizer of claim 9, wherein the butterfly operation circuit contains an adder including a capacitor, an operational amplifier having an amplifier input and an amplifier output, a plurality of input impedance elements connected to the amplifier input, and a feedback impedance element provided between the amplifier output and the amplifier input.

13. The signal characterizer of claim 12, wherein the impedances of the input impedance elements are equal to the impedance of the feedback impedance element.

14. The signal characterizer of claim 9, wherein the butterfly operation circuit contains a subtractor including a differential operational amplifier having an amplifier input and an amplifier output, a plurality of input impedance elements connected to the amplifier input, and a feedback impedance element provided between the amplifier input and the amplifier output.

15. The signal characterizer of claim 14, wherein the impedances of the input impedance elements being equal to the impedance of the feedback impedance element.

16. The signal characterizer of claim 9, wherein the butterfly operation circuit contains a multiplier which a capacitor, an operational amplifier having an amplifier input and an amplifier output, input impedance elements connected to the amplifier input, and a feedback impedance element provided between the amplifier output and the amplifier input such that the input impedance elements and the feedback impedance element define a multiplication value of the multiplier.

17. A signal characterizer applying a functional transformation to a serial analog signal, comprising:

an analog-type serial-to-parallel converter which converts the serial analog signal to a plurality of discrete parallel signals arranged in predetermined order;

a functional transformer, coupled to the serial-to-parallel converter, having a plurality of parallel input terminals which input the discrete parallel signals, a butterfly operation circuit which transforms the discrete parallel signals into a plurality of transformed signals according to a predetermined functional transformation, and a plurality of parallel output terminals, equal in number to the parallel input terminals, which output the transformed signals;

an output switch, having a serial output terminal, which supplies the transformed signals from the parallel output terminals to the serial output terminal;

an output switch controller which generates an output switch control signal to control the output switch in order to output the transformed signals to the serial output terminal sequentially, wherein, the analog-type serial-to-parallel converter contains an analog shift register having a plurality of sample holders connected in series, and each of the sample holders contains an output terminal connected to one of the parallel input terminals.

* * * * *